US006916779B2

(12) United States Patent
Gregory et al.

(10) Patent No.: US 6,916,779 B2
(45) Date of Patent: Jul. 12, 2005

(54) FABRIC CONDITIONING COMPOSITIONS

(75) Inventors: Denis James Gregory, Merseyside (GB); Jordan Todorov Petkov, Merseyside (GB); Sarah Wylde, Merseyside (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 155 days.

(21) Appl. No.: 10/402,307

(22) Filed: Mar. 28, 2003

(65) Prior Publication Data

US 2003/0186835 A1 Oct. 2, 2003

(30) Foreign Application Priority Data

Mar. 28, 2002 (GB) ..... 0207483

(51) Int. Cl.[7] ..... C11D 1/835
(52) U.S. Cl. ..... 510/515
(58) Field of Search ..... 510/515

(56) References Cited

U.S. PATENT DOCUMENTS

| | | | | |
|---|---|---|---|---|
| 3,984,335 A | | 10/1976 | Ciko et al. | |
| 4,421,792 A | * | 12/1983 | Rudy et al. | 427/242 |
| 4,427,558 A | | 1/1984 | David | |
| 4,814,095 A | * | 3/1989 | Puchta et al. | 510/521 |
| 4,911,851 A | * | 3/1990 | Ladd et al. | 510/297 |
| 5,259,964 A | | 11/1993 | Chavez et al. | |
| 6,110,886 A | | 8/2000 | Scepanski | |

FOREIGN PATENT DOCUMENTS

| | | | |
|---|---|---|---|
| EP | 0 011 333 A | | 5/1980 |
| EP | 0 107 479 | | 5/1984 |
| EP | 0 267 999 | | 5/1988 |
| EP | 0 345 495 A | | 12/1989 |
| EP | 0 111 074 | | 4/1990 |
| EP | 0 234 082 | | 8/1990 |
| EP | 0 568 297 | | 11/1993 |
| EP | 0 881 279 A | | 12/1998 |
| GB | 2 348 435 | | 10/2000 |
| JP | 62 057639 | | 3/1987 |
| JP | 02 182972 | | 7/1990 |
| JP | 06-306769 | * | 1/1994 |
| JP | 06 306769 | | 11/1994 |
| WO | 92/18593 | | 10/1992 |
| WO | 94/04643 | | 3/1994 |
| WO | 00/60039 | | 10/2000 |

OTHER PUBLICATIONS

*PCT Search Report No. PCT/EP 03/02106 dated Jul. 4, 2003, 3 pp.*

WPI Acc. No. 1989–357564/198949 Derwent abstract of EP 0 345 495 A2 —1 p.

WPI Acc. No. 1999–001386/199901 Derwent abstract of EP 0 881 279 A2 —1 p.

*UK Search Report No. GB 0207483.9 dated Sep. 18, 2002, 1 page.*

WPI Acc.No. 1990–258558/199034 Abstract of JP 02 182971.

WPI Acc.No. 1995–019866/199503 Abstract of JP 06 306769.

WPI Acc.No. 1987–112239/198716 Abstract of JP 62 057639.

* cited by examiner

*Primary Examiner*—John R. Hardee
(74) *Attorney, Agent, or Firm*—Ellen Plotkin

(57) ABSTRACT

A solid fabric conditioning composition comprises a cationic fabric softening agent, one or more carrier materials, perfume and a deposition aid for depositing the cationic fabric softening agent onto fabrics during a laundry treatment operation wherein the deposition aid is citric acid or a salt of citric acid.

7 Claims, No Drawings

FABRIC CONDITIONING COMPOSITIONS

FIELD OF THE INVENTION

The present invention relates to fabric conditioning compositions. More particularly the invention relates to solid fabric conditioning compositions having excellent deposition properties onto fabrics and/or delivering good perfume substantivity to fabrics.

BACKGROUND OF THE INVENTION

Traditionally, fabric conditioning has been carried out either during the rinsing step of a fabric washing and rinsing process or during tumble drying of the fabric. Typically, rinse conditioning is accomplished by adding a liquid dispersion of a rinse conditioning agent to the rinse liquor. The liquid dispersion was traditionally distributed and made available to consumers as a ready to use aqueous dispersion. More recently, concern for the environment and consumer convenience has led to the sale of concentrated aqueous dispersions which are either used in smaller amounts or are mixed with water to form a dilute composition before use.

In EP 234082 it has been proposed to supply rinse conditioner as a solid block. This approach requires the use of a special restraint for the block and may also require the modification of the washing machine to enable the block to be dissolved and dispensed by a spray system. Various proposals have been made to supply fabric softener in granular or powdered form.

EP 111074 discloses a powdered rinse conditioner based on a silica carrier for the softening agent. A disadvantage of using a carrier such as silica is that it can cause bulking of the product and appears to serve no function beyond making the powder compatible with other ingredients that may be contained in a washing powder.

WO 92/18593 describes a granular fabric softening composition comprising a nonionic fabric softener and a single long alkyl chain cationic material. The specification teaches that effective cationic softening compositions when used in granular form exhibit poor dispersion properties and so, despite the obvious environmental and transport saving advantages of selling a water free powdered rinse conditioner, manufacturers have not done so.

EP-B1-0568297 discloses a powdered rinse conditioner comprising a water insoluble cationic active and a nonionic dispersing agent.

It is known that solid fabric conditioners can be formed by combining quaternary ammonium compounds with a water soluble carrier such as urea.

U.S. Pat. No. 5,259,964 (Colgate-Palmolive) discloses a free flowing spray-dried rinse conditioner. U.S. Pat. No. 4,427,558 (Unilever) discloses a method of preparing fabric softening particles comprising a cationic fabric conditioning material, urea and a salt of a fatty acid.

A problem with powdered rinse conditioners is that, once dissolved/dispersed in the rinse liquor, it is difficult to achieve good deposition of the softening agent onto the fabric being treated.

Deposition aids have been proposed for depositing clay softeners. For example, WO-Al-00/60039 (Proctor and Gamble) discloses a solid rinse conditioner comprising clay, surfactant, a solid carrier and a flocculating agent which aids deposition of the clay. The preferred flocculating agent is an organic polymer such as polyethylene oxide.

EP-A-0107479 (Unilever) discloses a liquid or granular rinse conditioner comprising a nonionic conditioner (such as sorbitan monostearate) and aluminium chloro-hydrate which acts as a deposition aid for the nonionic conditioner.

EP-A-0267999 (Unilever) discloses a liquid or powder rinse conditioner comprising a non-cationic softener and a nonionic cellulose ether derivative as a deposition aid for the softener.

JP 06306769 (Kao) discloses a solid fabric softener comprising a tertiary amine, a quaternary ammonium salt and urea or a water soluble inorganic salt.

JP 62057639 (Lion) discloses the production of cationic surfactant granules in which a dialkyl quaternary ammonium powder is granulated with an alkali metal chloride or an alkaline earth metal chloride. The chloride is present to improve softness.

JP 02182972 (Kao) discloses a solid softening agent comprising a dialkyl quaternary ammonium salt, a monoalkyl quaternary ammonium salt and urea or a urea derivative. The composition may also contain a water soluble inorganic salt such as sodium chloride, sodium sulphate, magnesium sulphate and potassium nitrate.

Surprisingly, it has now been found that a solid rinse conditioning composition comprising a cationic softening agent and a carrier, such as urea, provides significantly improved deposition of the cationic softening agent onto fabrics when citric acid or a salt of citric acid is present in the formulation. Furthermore, it is found that greater perfume strength is imparted to dried fabrics which have been treated with such compositions.

Salts of citric acid have been disclosed in solid detergent formulations. See, for instance, WO 94/04643 (Colgate Palmolive) and U.S. Pat. No. 6,110,886 (Sunburst).

U.S. Pat. No. 4,814,095 (Henkel) discloses an afterwash textile treatment preparation based on a layer silicate and comprising citric acid, a zeolite and urea. The citric acid is used as a neutralising and disintegrating agent. Example 5 discloses a composition comprising a single chain quaternary ammonium material (tetradecyl trimethyl ammonium bromide). This is not a fabric softening agent.

GB-A-2348435 discloses, in example D, a composition comprising QEA, QAS, citric acid, perfume, sodium sulphate and sodium carbonate. QEA and QAS appear to be highly soluble materials and would thus be ineffective as fabric softening agents. Suitable softening components are described on page 3 and include a surfactant component selected from anionic or nonionic surfactants.

None of the prior art has identified that, in a fabric conditioning composition comprising a cationic softening agent and a carrier such as urea, citric acid or a salt of citric acid provides excellent deposition of the softening agent onto the fabrics being treated.

In addition, there is nothing in the prior art which suggests that improved perfume strength on dried fabrics can be achieved using such compositions.

STATEMENT OF INVENTION

Thus, according to the present invention there is provided a solid fabric conditioning composition comprising:

(a) one or more cationic fabric softening agents;

(b) one or more carrier materials;

(c) perfume; and (d) a deposition aid for depositing the cationic fabric softening agent onto fabrics during a laundry treatment operation wherein the deposition aid is citric acid or a salt of citric acid.

DETAILED DESCRIPTION OF THE INVENTION

Cationic Fabric Softening Agent

The cationic fabric softening agent is preferably a quaternary ammonium fabric softening material. Preferably the quaternary ammonium fabric softening material has two $C_{12-28}$ alkyl or alkenyl groups connected to the nitrogen head group, preferably via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The first group of carbonic fabric softening compounds for use in the invention is represented by formula (I):

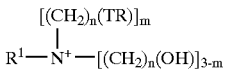

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

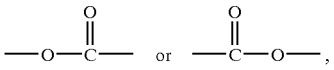

n is 0 or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this formula are di-alkenyl esters of triethanol ammonium methyl sulphate and N-N-di(tallowoyloxy ethyl) N,N-dimethyl ammonium chloride. Commercial examples include Tetranyl AHT-1 (di-hardened oleic ester of triethanol ammonium methyl sulphate 80% active), AT-1 (di-oleic ester of triethanol ammonium methyl sulphate 90% active), L5/90 (palm ester of triethanol ammonium methyl sulphate 90% active), all ex Kao. Other unsaturated quaternary ammonium materials include Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation.

The second group of cationic fabric softening compounds for use in the invention is represented by formula (II):

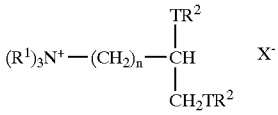

Formula (II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2 bis [tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably thee materials also comprise small amounts the corresponding monoester, as described in U.S. Pat. No. 4,137,180.

A third group of cationic fabric softening compounds for use in the invention is represented by formula (III):

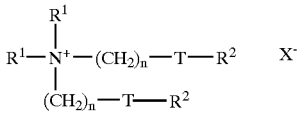

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

A fourth group of cationic fabric softening compounds for use in the invention is represented by formula (IV):

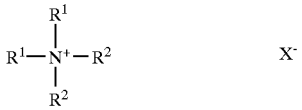

(IV)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; and $X^-$ is as defined above.

Where the quaternary ammonium raw material is provided in a solvent, it is particularly preferred that the solvent is evaporated off to give a solid product which is then milled to give a powder of the quaternary ammonium material of mean particle size within the range 100 to 1200 μm, more preferably from 200 to 1000 μm, most preferably from 300 to 800 μm, e.g. 400 to 600 μm.

The compositions preferably comprise from 10 to 95% by weight of cationic softening material (active ingredient), based on the total weight of the composition, more preferably 15 to 75% by weight, most preferably 20 to 50% by weight, e.g. 22 to 45% by weight.

Iodine Value of the Parent Fatty Acyl Group or Acid

The iodine value of the parent fatty acyl compound or acid from which the cationic softening material is formed is from 0 to 140, preferably from 0 to 100, more preferably from 0 to 60.

It is specially preferred that the iodine value of the parent compound is from 0 to 20, e.g. 0 to 5. Where the iodine value is 5 or less, the softening material provides excellent softening results and has improved resistance to oxidation and associated odour problems upon storage.

In the context of the present invention, iodine value of the parent fatty acyl compound or acid from which the cationic surfactant is formed, is defined as the number of grams of iodine which react with 100 grams of the compound.

One method for calculating the iodine value of a parent fatty acyl compound/acid from which the cationic softening compound is formed, comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M) To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated. Other methods for calculating the IV of a parent fatty acyl compound or fatty acid of a softening compound will be apparent to the person skilled in the art.

Deposition Aid

The deposition aid used in the compositions of the present invention is citric acid or a salt of citric acid.

If the deposition aid is a salt of citric acid, it is preferably water soluble. By water soluble, it is meant that the salt has a solubility in excess of 1 gram per litre, preferably in excess of 25 grams per litre.

The counter ion in the salt is preferably an alkaline earth metal, ammonium or alkalimetal. Preferably, it comprises an alkalimetal cation or ammonium. Typically preferred are sodium, potassium or ammonium salts.

The deposition aid is preferably present in an amount from 0.005% to 20% by weight, more preferably from 0.01% to 10% by weight, most preferably from 0.1% to 5% by weight, based on the total weight of the composition.

Carrier Material

The solid composition comprises a carrier material. Preferred carrier materials are those which aid the preparation of a dry, free-flowing powder which disperses readily in water.

Especially preferred carriers are based on urea. The most preferred carrier is urea since it is a simple, easily available product which enables production of a fabric conditioning composition without recourse to expensive carriers.

Other suitable carriers include water soluble inorganic salts such as sodium chloride, potassium chloride, magnesium chloride, sodium sulphate, potassium sulphate, magnesium sulphate, sodium carbonate and sodium sesquicarbonate.

The carrier may also comprise a mixture of one or more the aforementioned salts.

The carrier material is preferably present in an amount from 10 to 95% by weight, more preferably 25 to 85% by weight, most preferably 40 to 70% by weight, based on the total weight of the composition.

Perfume

The compositions of the invention comprise one or more perfumes. Typical perfumes suitable for use in the present invention are disclosed in "Perfume and Flavor Chemicals (Aroma Chemicals)", by Steffen Arctander, published by the author in 1969, the contents of which are incorporated herein by reference.

Preferably the perfume is present in an amount from 0.01 to 10 wt %, more preferably 0.05 to 7 wt %, most preferably 0.1 to 5 wt % based on the total weight of the composition.

A particularly preferred method for incorporating the perfume into the composition is described in U.S. Pat. No. 6,200,949, incorporated by reference herein.

Zeolite

The compositions of the invention preferably comprise a zeolite. Preferred zeolites include alkali metal, preferably sodium, aluminosilicates.

Zeolites may be incorporated in amounts of from 0.1 to 50% by weight (anhydrous basis), preferably from 1 to 30 wt %, based on the total weight of the composition.

The zeolite is not present in an amount greater than 50% by weight, based on the total weight of the composition, since the resultant solid has poor flow properties, e.g. the particle size is so small that the product is in the form of a dust.

The zeolite may be either crystalline or amorphous or mixtures thereof, having the general formula:

$$0.8\text{–}1.5\ Na_2O.Al_2O_3.0.8\text{–}6\ SiO_2$$

These materials contain some bound water and should have a calcium ion exchange capacity of at least 50 mg CaO/g. The preferred sodium aluminosilicates contain 1.5–3.5 $SiO_2$ units (in the formula above). Both the amorphous and the crystalline materials can be prepared readily by reaction between sodium silicate and sodium aluminate, as is typical is the art.

Suitable crystalline sodium aluminosilicate ion-exchange detergency builders are described, for example, in GB 1 429 143 (Procter & Gamble). The preferred sodium aluminosilicates of this type are the well-known commercially available zeolites A and X, and mixtures thereof.

A particularly preferred zeolite is zeolite 4A.

It has been found that the solid compositions of the present invention, which comprise a cationic softener and a carrier, such as urea, have excellent flow properties (typically exhibiting flow rates of 90 ml/s or more, more preferably 100 ml/s or more, most preferably 110 ml/s or more).

However, in the absence of zeolite, such flow rates are only achieved across a narrow wt % range of the cationic softener. By incorporating a zeolite into the composition, the excellent flow properties can be achieved over a much broader wt % range of the cationic softener.

In particular, it has been found that the presence of the zeolite enables much higher levels of the cationic softener to be present in the composition without detrimentally affecting the flow properties of the solid.

In use, when the solid composition is added to liquid, e.g. water, the zeolite rapidly disperses to give a milky solution. Although not essential to the invention, this provides a highly desirable attractive appearance to the composition.

Fatty Alcohol

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 10% by weight, more preferably from 0.005 to 5% by weight, most preferably from 0.01 to 3% by weight, based on the total weight of the composition.

Nonionic Surfactants

It is preferred that the compositions further comprise a nonionic surfactant. Typically these can be included for the purpose of stabilising the compositions.

Suitable nonionic surfactants include addition products of ethylene oxide and/or propylene oxide with fatty alcohols, fatty acids and fatty amines.

Any of the alkoxylated materials of the particular type described hereinafter can be used as the nonionic surfactant.

Suitable surfactants are substantially water soluble surfactants of the general formula:

$$R—Y—(C_2H_4O)_z—C_2H_4OH$$

where R is selected from the group consisting of primary, secondary and branched chain alkyl and/or acyl hydrocarbyl groups; primary, secondary and branched chain alkenyl hydrocarbyl groups; and primary, secondary and branched chain alkenyl-substituted phenolic hydrocarbyl groups; the hydrocarbyl groups having a chain length of from 8 to about 25, preferably 10 to 20, e.g. 14 to 18 carbon atoms.

In the general formula or the ethoxylated nonionic surfactant, Y is typically:

$$—O—,\ —C(O)O—,\ —C(O)N(R)—\ \text{or}\ —C(O)N(R)R—$$

in which R has the meaning given above or can be hydrogen; and Z is at least about 8, preferably at least about 10 or 11.

Preferably the nonionic surfactant has an HLB of from about 7 to about 20, more preferably from 10 to 18, e.g. 12 to 16.

Examples of nonionic surfactants follow. In the examples, the integer defines the number of ethoxy (EO) groups in the molecule.

A. Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are $C_{18}$ EO(10); and $C_{18}$EO(11). The ethoxylates of mixed natural or synthetic alcohols the "tallow" chain length range are also useful herein. Specific examples of such materials include tallow alcohol-EO(11), tallow alcohol-EO(18), and tallow alcohol-EO(25), coco alcohol-EO(10), coco alcohol-EO(15), coco alcohol-EO(20) and coco alcohol-EO(25).

B. Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having an HLB within the range recited herein are useful viscosity and/or dispersibility modifiers in the context of this invention. Exemplary ethoxylated secondary alcohols useful herein as the viscosity and/or dispersibility modifiers of the compositions are: $C_{16}$ EO(11); $C_{20}$ EO(11); and $C_{16}$ EO(14).

C. Alkyl Phenol Alkoxylates

As in the case of the alcohol alkoxylates, the hexa- to octadeca-ethoxylates of alkylated phenols, particularly monohrydric alkylphenols, having an HLB within the range recited herein are useful as the viscosity and/or dispersibility modifiers of the instant compositions. The hexa- to octadeca-ethoxylates of p-tri-decylphenol, m-pentadecylphenol, and the like, are useful herein. Exemplary ethoxylated alkylphenols useful as the viscosity and/or dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

D. Olefinic Alkoxylates

The alkenyl alcohols, both primary and secondary, and alkenyl phenols corresponding to those disclosed immediately hereinabove can be ethoxylated to an HLB within the range recited herein and used as the viscosity and/or dispersibility modifiers of the instant compositions.

E. Branched Chain Alkoxylates

Branched chain primary and secondary alcohols which are available from the well-known "OXO" process can be ethoxylated and employed as the viscosity and/or dispersibility modifiers of compositions herein.

F. Polyol Based Surfactants

Suitable polyol based surfactants include sucrose esters such sucrose monooleates, alkyl polyglucosides such as stearyl monoglucosides and stearyl triglucoside and alkyl polyglycerols.

The above nonionic surfactants are useful in the present compositions alone or in combination, and the term "nonionic surfactant" encompasses mixed nonionic surface active agents.

The nonionic surfactant is present in an amount from 0.01 to 15%, more preferably 0.1 to 12%, most preferably 0.35 to 10%, e.g. 0.5 to 7% by weight, based on the total weight of the composition.

Flow Aid

A flow aid is optionally present in the compositions of the invention.

The flow aid preferably comprises a fine particulate material which coats the solid, e.g. powder granules, providing improvements in storage and handling properties.

Preferred flow aids are the commercially available sodium aluminosilicates, zeolite A, zeolite MAP and Alusil.

Of course, if the flow aid is a zeolite it may also act as a carrier for the cationic softening material.

The flow aid is preferably present in an amount from 0.001% to 10% by weight, more preferably from 0.01% to 5% by weight, most preferably from 0.1% to 2% by weight, based on the total weight of the composition. If the flow aid is a zeolite, higher levels can be present.

The flow aid is typically the final ingredient to be added to the composition once he solid is substantially already formed.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids, dyes and fatty acids.

Product Form

The compositions of the present invention are solids, such as powders tablets or bars. It is particularly preferred that the solid is a free-flowing powder. Ideally the powder has a mean particle size of less than 1000 microns as this improves the flow and dispersion characteristics of the powder. More preferably the mean particle size is less than 700 microns. Preferably the dynamic flow rate of the powder is greater than 90 ml/s and more preferably greater than 100 ml/s. Preferably the bulk density of the powder is less than 800 g/L.

Product Use

The product is preferably used in the rinse stage of a laundry process. It is envisaged that the product is suitable for use in hand rinsing or machine rinsing operations.

EXAMPLES

The invention will now be illustrated by the following non-limiting examples. Further modifications will be apparent to the person skilled in the art.

Samples of the invention are represented by a number. Comparative samples are represented by a letter.

All values are % by weight of the active ingredient unless stated otherwise.

Suitable methods for preparing the solid compositions are as follows:

In a first method, the carrier (e.g. urea) and other solids (such as zeolite and citrate) are added to a mixer and mixed for 10–15 seconds. Suitable mixers include the Sirman C6 mixer granulator and the Fukae FS30 mixer. Other types of mixers could also be used including drum mixers, ploughshares and fluid bed mixers. The quaternary ammonium material is heated until molten and added to the solids in the mixer. Optional formulation aids, such as nonionic surfactant and tallow alcohol, can be co-melted with the quaternary ammonium material. Other optional ingredients, such as perfume and dye, are added separately to the solids. The mixture is then granulated for between 15–30 seconds and an optional low aid may be added with a further 5 seconds mixing. If the composition is too wet it can be weathered to allow the liquid components to equilibrate within the powder structure, providing a dry free-flowing powder.

In an alternative process, the carrier (e.g. urea) is mixed with a powdered quaternary ammonium material. In this case the quaternary ammonium material is not melted. Other solids (such as zeolite and citrate) are added and mixed. If required a binder, such as a nonionic surfactant and/or polyethylene glycol, can be added to improve granulation.

The compositions of table 1 were prepared according to method 1 above.

TABLE 1

| Sample | 1 | A | B | C | D |
|---|---|---|---|---|---|
| Urea (1) | 45.0 | 55.0 | 55.0 | 50.0 | 47.8 |
| Softener | 25.0 (2) | 25.0 (2) | 20.8 (2) | 25.0 (2) | 29.4 (3) |
| Sodium citrate (4) | 10 | 0 | 0 | 0 | 0 |
| Tallow alcohol (5) | 0 | 0 | 4.2 | 0 | 0 |
| Flow aid (6) | 1.0 | 1.0 | 1.0 | 1.0 | 1.0 |
| Nonionic surfactant (7) | 0 | 0 | 0 | 5 | 0 |
| Zeolite (8) | 17.2 | 17.2 | 17.2 | 17.2 | 20.0 |
| Perfume | 1.8 | 1.8 | 1.8 | 1.8 | 1.8 |

(1) Urea Pure A, ex BASF
(2) Tetranyl AHT-1, ex Kao, where any solvent is removed by evaporation in a fume cupboard, and the solid milled using a Moulinex food mixer to give powder of mean particle size within range 200 to 600 $\mu$m.
(3) Tetranyl AHT LV0009, ex Kao (85% active, 15% IPA)
(4) ex ADM
(5) Laurex CS, ex Albright & Wilson
(6) Alusil, ex Crosfield
(7) Neodol 91-7E, a C9–11 alcohol containing 7 ethoxylate groups, ex Shell
(8) Wessalith P, 80% active in 20% water, ex Crosfield

Example 1

Deposition Evaluation

Deposition of the cationic softener onto fabrics was assessed by evaluating the intensity and evenness of "free" cationic softener deposited onto the terry towelling fabric as follows.

0.7 g bromophenol blue dye was dissolved in log ethanol and added to a small amount of boiling demineralised water. This was added to 10 litres of cold Wirral water. Terry towelling cloth monitors were soaked in the bromophenol blue solution for 15 minutes with a little agitation, the dye solution to cloth weight ratio being 50:1. The monitors were then rinsed in 8 to 10 litres of cold Wirral water until the water ran clear. 0.5 g citric acid monohydrate was added to he rinse water to prevent the dye rinsing off. The cloths were spun and then line dried in the dark. Cloths were visually assessed by an expert panel to quantity (a) the intensity of the stain (and thus the degree of deposition of the cationic softening agent; on a scale of 0 to where 0 represents no staining and 5 represents intense staining and (b) the evenness of distribution on a scale of 0 to 5 where 0 denotes uneven coverage and 5 denotes even coverage.

The average intensity and evenness scores are given in table 2 below.

TABLE 2

| Sample | Intensity | Evenness |
|---|---|---|
| 1 | 4.4 | 3.7 |
| A | 2.9 | 1.8 |
| B | 3.3 | 2.6 |
| C | 4.3 | 3.5 |
| D | 2.6 | 1.8 |

Example 2

Softening Evaluation

Softening assessments were carried out as follows:

Anionic carry-over was simulated by measuring 1 ml of 1 wt % LAS in a Terg-o-tometer pot. The rinse product sample (1 to 5 above) was weighed out each time to an equivalent of 2.6 g/l. Three terry towelling monitors (20×20 cm) weighing 40 g were rinsed in a litre of water at ambient temperature. Monitors were removed and the rinse product sample added the cloths. The cloths were then replaced into the Terg-o-tometer pot and rinsed for a further 5 minutes. The cloths were removed, spun and ten line dried. The monitors were divided into 6 sets; the softness of the terry towelling of two sets was assessed by an expert panel of judges using the paired round robin comparison method. The remaining four sets were ranked on a softness scale from 1 (denoting soft to 8 denoting harsh). The data was analysed using SAS co determine significant differences.

The average scores are given below in table 3.

TABLE 3

| Sample | Softness |
|---|---|
| 1 | 3.1 |
| A | 4.3 |
| B | 4.9 |
| C | 4.0 |
| D | 3.1 |

Example 3

Perfume Evaluation

Cloths were prepared in the manner described above for softness evaluation. The treated cloths were line dried for 24 hours.

The cloths were then evaluated by an expert panel of at least 12 people, with each panellist being given 3 monitors. Assessment was made on a scale from 0 to 5 where 0 denotes no perfume and 5 denotes very strong perfume.

The average results are given in table 4 below.

TABLE 4

| Sample | Perfume Intensity |
|---|---|
| 1 | 3.5 |
| A | 2.2 |
| B | 1.7 |
| C | 1.9 |
| D | 2.5 |

What is claimed is:

1. A solid fabric conditioning composition comprising:

(a) from 15 to 75 wt % of one or more cationic fabric softening agents;

(b) from 25 to 85 wt % of urea carrier materials;

(c) perfume; and (d) from 0.1 to 5 wt % of a deposition aid for depositing the cationic fabric softening agent onto fabrics during a laundry treatment operations; wherein the deposition aid is citric acid or a salt of citric acid; and (e) further comprising a fatty alcohol.

2. A solid fabric conditioning composition as claimed in claim 1 wherein the deposition aid is an alkaline earth metal citrate or alkali metal citrate.

3. A solid fabric conditioning composition as claimed in claim 2, wherein the deposition aid is sodium citrate.

4. A solid fabric conditioning composition as claimed in claim 1 wherein the cationic softening material comprises a quaternary ammonium compound.

5. A solid fabric conditioning composition as claimed in claim 1 wherein the solid is in the form of a powder having a mean particle size of less than 700 microns.

6. A solid fabric conditioning composition as claimed in claim 1 wherein the cationic softening material is represented by the formula:

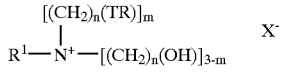

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group, T is

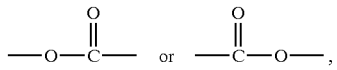

n is 0 or a number selected from 1 to 4, m is 1, 2 or 3 and denotes the number of moieties to which it relates that pend directly from the N atom, and X is an anionic group; or by the formula Formula (II)

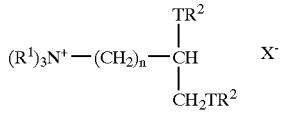

wherein each $R^1$ group is independently selected from $_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and X are as defined above.

7. A solid fabric conditioning composition as claimed in claim 6 wherein the iodine value of the parent compound from which the cationic softening material is formed is from 0 to 60.

* * * * *